US005311933A

United States Patent [19]

Lee

[11] Patent Number: 5,311,933

[45] Date of Patent: May 17, 1994

[54] CONNECTION OF TANK TO CORE FOR HEAT EXCHANGER

[76] Inventor: Lanny R. Lee, 926 Essex Rd., Westbrook, Conn. 06498

[21] Appl. No.: 7,250

[22] Filed: Jan. 21, 1993

[51] Int. Cl.[5] ..... F28F 9/02

[52] U.S. Cl. ..... 165/149; 165/153; 165/173

[58] Field of Search ..... 165/173, 153, 149; 29/890.052

[56] References Cited

U.S. PATENT DOCUMENTS

| | | | |
|---|---|---|---|
| 4,324,290 | 4/1982 | Moranne | 165/153 |
| 4,331,201 | 5/1982 | Hesse | 165/153 |
| 4,461,348 | 7/1984 | Toge et al. | 165/173 |
| 4,546,823 | 10/1985 | Melnyk | 165/149 |
| 4,600,051 | 7/1986 | Wehrman | 165/149 |
| 4,651,815 | 3/1987 | Logic | 165/76 |
| 4,881,595 | 11/1989 | Damsohn et al. | 165/173 |

FOREIGN PATENT DOCUMENTS

| | | | |
|---|---|---|---|
| 2703528 | 8/1978 | Fed. Rep. of Germany | 165/173 |
| 2528561 | 12/1983 | France | 165/173 |
| 497144 | 8/1954 | Italy | 165/149 |

*Primary Examiner*—John Rivell
*Assistant Examiner*—L. R. Leo

[57] ABSTRACT

The heat exchanger comprises a core of tubes engaged into header plates with a groove and an upstanding wall about the periphery. The upstanding wall has spaced of set tabs or dogs in openings which engage a shoulder along the rim of the tank. Also included is a tool to bias the dog for tank removal.

10 Claims, 2 Drawing Sheets

FIG 1
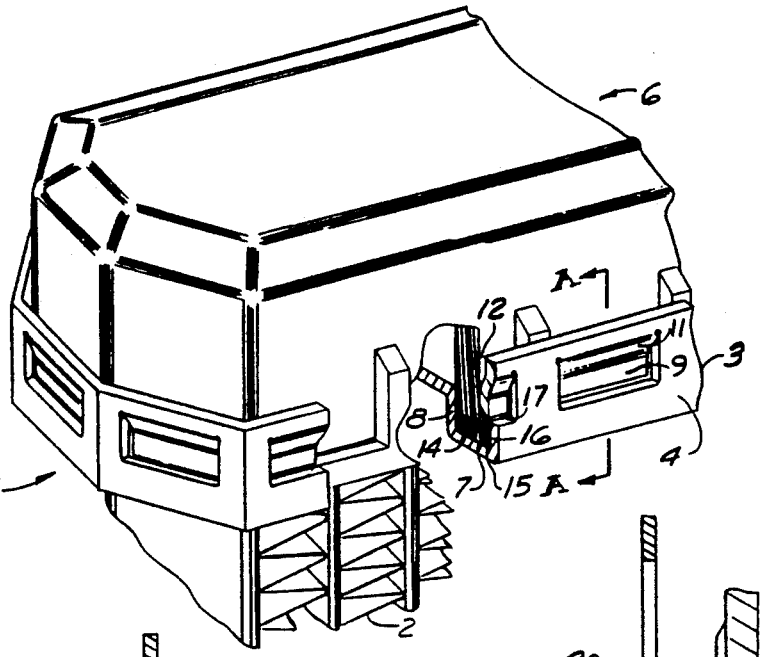
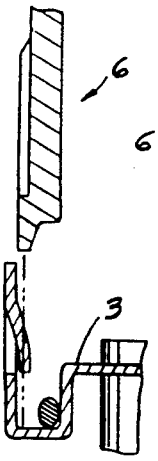
FIG 3
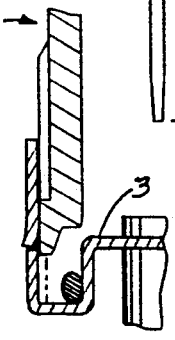
FIG 4
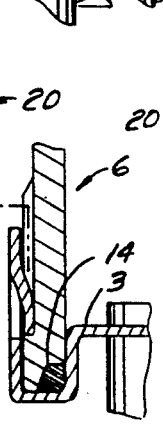
FIG 5
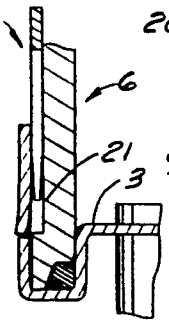
FIG 6
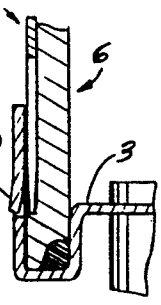
FIG 7
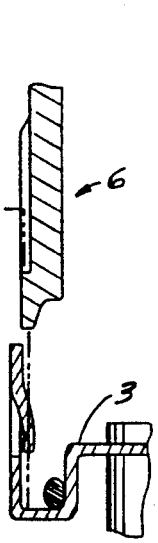
FIG 8
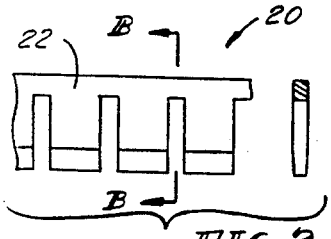
FIG 2
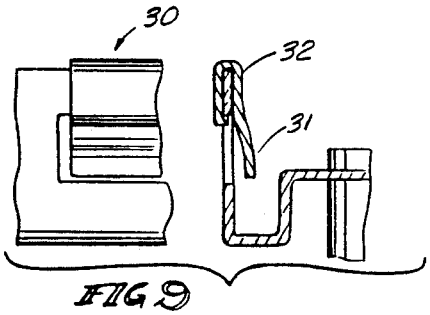
FIG 9

CONNECTION OF TANK TO CORE FOR HEAT EXCHANGER

FIELD OF THE INVENTION

Relates to the joining of the tank to the core of a heat exchanger.

BACKGROUND OF THE INVENTION

Prior art of possible revealing includes the following U.S. Letters Pat. No. 4,324,290 issued Apr. 13, 1982 to Moranne; U.S. Pat. No. 4,331,321 issued May 25, 1982 to hesse; U.S. Pat. No. 4,448,321 issued May 15, 1984 to Hanlet; and U.S. Pat. No. 4,651,815 issued Mar. 24, 1987 to Logic et al.

Efforts of the automotive industry to boost the horsepower and efficiency while reducing the gas emissions and vehicle weight have also caused higher operating temperatures. Because, of these new higher temperatures levels, the loss of coolant liquids can quickly result in major engine damage. Heat exchangers, more commonly termed radiators, are used conduct the heat away from the liquid coolant. While core construction employing metals continue to be used because of their thermal conductivity over other materials the header tank construction has given way to become a one piece plastic part.

Most typically, these tanks were brazed or soldered to the core header plates which define the ends of the core pile tubes. Because of the properties of plastic, bonding or fusing technology can no longer be employed. In lieu therefore, to effect the necessary seal, a gasket is disposed between the tank and the header plate. Any of a variety of mechanical means are employed to hold the components in assembled relation while the gasket is in compression, to assure a seal, at the operating pressure for which the heat exchanger was designed.

All previous connections make use of the core metals as a spring clamp, however, all of these materials have poor spring qualities and major deforming should be avoided except when in the dead soft condition. Cracking or breaking is likely when in the annealed condition if more than a slight deflection. An assembled radiator could not be annealed because the high temperature required are much higher than plastics can withstand.

Some prior art connections require drastic bending of the header tank to provide clearance for either a flange or lug to disconnect the tank whereby recantation is impractical. It is also noted that these connection are, likewise, held by bending stresses. Another prior art connection shows hooked lugs formed on the tank wall poking thru apertures. This arrangement, as with the flange is a highly stressed area and the applied forces are cantilevered from the wall. There are no plastic tank type automotive radiator parts available; only complete radiators ar sold to replace a leaking or otherwise damaged radiator. The failed radiator has little scrap value because of the labor required salvage the metal core from the plastic tank.

It is, of course, necessary that the means employed to effect the connection be strong and long lived to prevent leakage. At the same time, it is desirable that the means be such that assembly of the component parts can be effected for servicing. It is also desirable that the means utilized lend themselves to use in mass production to minimize cost.

SUMMARY OF THE INVENTION

It is therefore, an object of the present invention to provide an improved clamped connection.

It is a further objective of the invention to provide a reliable connection that is easily mass produced.

It is also an object to provide a connection that the compression is maintained with compression stress loading.

Another object of the invention to provide an improved heat exchanger embodying the clamped connection according to the invention.

In accomplishing the foregoing objects, there has been provided in accordance with the present invention a clamped connection comprising a first part a tank having a shoulder; a second part a core having an edge and a edge region having a trihedral groove adjacent to the edge.

The edge region of the core is deformed from the first condition in which the edge region is continuous and straight or has a constant radius of curvature along most of its length and a second condition in which the inner portion of the edge region is deformed to the second condition to form a trihedral groove around the perimeter. This groove has a bottom, surrounded by a substantial upstanding wall having spaced openings and parallel to an inner wall. Said openings each created by three joining slots causing a tab or dog based along the edge to be set free then subsequently by means deformed from the first condition of being coplanar to the second condition of being jogged offset to the groove.

The tank has a rim and a shoulder parallel to and extending the rim wall and having an inaccurate on the opposite surface along the outer wall.

In accordance to the invention the compressible gasket is by means placed in the groove of the header plate followed by the tank shoulder which is then located adjacent to the upstanding wall. By means the rim is pressed to the groove bottom then the dog tip maintains this relationship by closing over the shoulder. According to yet another aspect of the invention there has been provided a heat exchanger, comprising a tank, a header plate holding a plurality of tubes end a clamped connection between the tank and the header plate, with the connection being that according to the present invention.

Further objects, features and advantages of the present invention will become readily apparent to the skilled artisan from the detailed description of preferred embodiments which follows, when considered together, with attached figures of drawings.

It is also an objective of the invention to provide a connection maintained by means of combined compression and shear.

DESCRIPTION TO HE DRAWINGS

FIG. 1 is a somewhat fragmentary, perspective view of a tank and header plate assembly made according to the invention;

FIG. 2 is a somewhat fragmentary plan view of a separation tool;

FIG. 3 is a somewhat schematic early view of section A—A of the assembly process of the tank to the header plate;

FIG. 4 is a view similar to FIG. 3 but at an intermediate stage in the assembly process; and FIG. 5 is a view also similar to FIG. 1 but showing the final stage of process and section B—B is introduced.

FIG. 6 is a view similar to FIG. 1, however, showing the early stage of separation;

FIG. 7 is a view similar to FIG. 1 but showing the intermediate stage of separation; and FIG. 8 is a view similar to FIG. 1 showing the tank separated from the header plate;

FIG. 9 is a view also similar to FIG. 3 but showing another embodiment;

Figure 10:
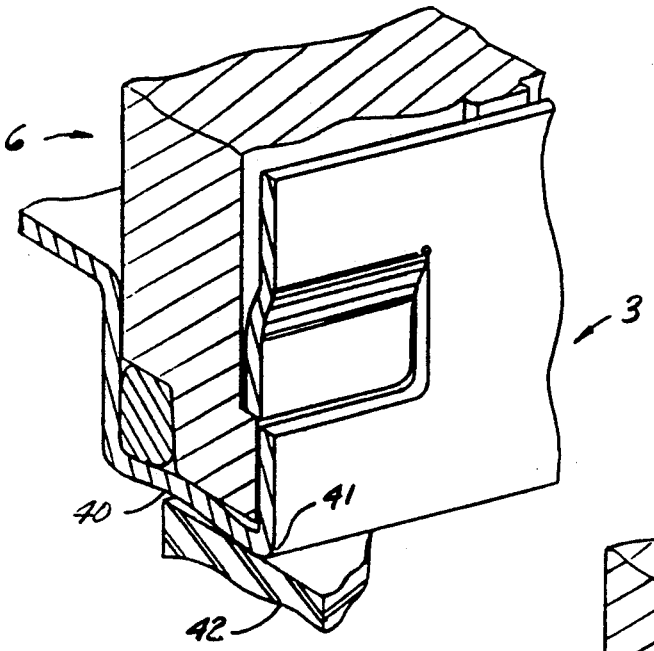

FIGS. 10, 11, 12, and 13 are enlarged views of breakout of FIG. 1, however, showing additional embodiments.

DESCRIPTION OF THE PREFERRED EMBODIMENT

In the drawings, reference numeral 1 designates the circulation tubes of the heat exchanger, particularly a cooling exchanger of the type used in motor vehicles. The tubes 1 are connected together in the usual manner by secondary heat exchanger elements 2 made for instance of corrugated bands or fins. The ends of the tubes 1 are engaged in header plates 3 which are made of a metal or an alloy compatible with the metal or alloy of the tubes 1 and the elements 2. These parts assembled into a unit by brazing of by any other suitable method comprise the core 5. According to the invention, there is used for covering a header tank 6 advantageously made of metal or plastic, although not shown, said tank 6 comprises in a known manner pipes, bases and other bases and other ducts which are usual of the art.

Referring to the drawings, FIG. 1, shows a header plate 3 having a upstanding wall 4, the trihedral groove and a shoulder 8 around the periphery. A dog 9 with a jog 11 a offset 12 is spaced in a opening formed by slits on said dog 9 sides. This arrangement is advantageously in plural spaced along said upstanding wall 4.

According to the invention a compressible gasket 14 is placed in trihedral groove on a bottom 7 and is covered by said tank 6.

The tank 6 having an a rim 15 which has a notch 16 to provide the sealing surfaces. A shoulder 17 parallel to and extends said rim 15 along the perimeter being an interference fit to the offset of the dog 9 surface. The tank 6 is by means forced past the dog 9 by depressing the dog 9, while also compressing said compressible gasket 14, whereby said rim 15 contacts said bottom 7 of the groove. Thereby permitting the tip of said dog 9 to regain the a free position and of being engaged in said shoulder 17 providing a champed connection.

FIG. 2 is a separation tool 20 device of uniform thickness material with a tooth 22 with equivalent spacing as said dog 9.

A preferred embodiment of the invention is demonstrated by the sequence of FIG. 3 thru FIG. 8 and starting with FIG. 3 is the first stage of the assembly process of the tank 6 to the header plate 3.

FIG. 4 accomplished by means, is the first entry of the tank 6 to the header plate 3.

The FIG. 5 is the final clamped connection of the tank 6 and the header plate 3 having achieved a seal according to the invention by compressing said gasket 14 while section B—B view of said separation tool 20 is posed in preparation, also according to the invention, to effect the separation.

An early stage of the separation as shown in FIG. 6 where said separation tool 20 is by means is being inserted in a gap 21 between the tank 6 and said upstanding wall 4

FIG. 7 shows said dog 9, by means of inserted said separation tool 20, disengaged from said shoulder 17.

Shown here in FIG. 8 are, the tank 6 and the header plate 5 by means separated using said separation tool 20, and also, by means withdrawn.

Another preferred embodiment of the invention can be seen in FIG. 9 as an added spring device, a spring clip 30. The upstanding wall has spaced aperture which in this embodiment serve advantageously as a means to anchor a retaining loop 32 and also provide clearance for the tip of the spring dog 31 when it is in the retracted position.

A highly preferred embodiment is seen in FIG. 10 as dog 9 is engaged and also in a preload condition, whereby, the assembly is carried out as before. However, the bottom 7 is a convex 40 and a corner 41 of the header plate 3 rests on a stationary fixture 42. The tank 6 is by means pressed hard to the crown on said convex 40 causing a deflection and allowing the shoulder to over travel the end of the dog 9 by a distance equal to the maximum manufacturing tolerance limits of the length of the dog 9. When the tank is released from pressure the dog 9 is in preload proportionate to the length.

Figure 11:
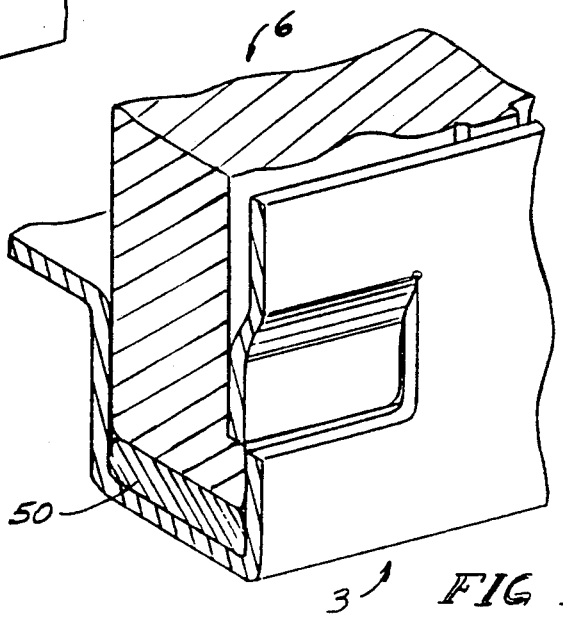

A similar embodiment is seen in FIG. 11 where preload is established by means of the compression seal 50.

Figure 12:
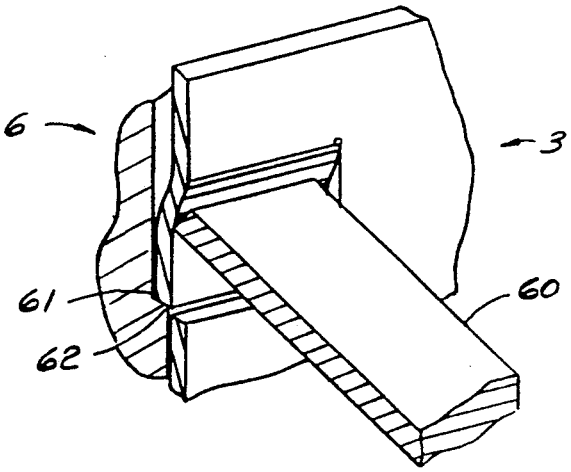

Another embodiment is shown by FIG. 12 where a preload is accomplished by interference fit between a tip 61 of the dog 9 and a shoulder edge 62 of the shoulder 17. A tool 60 is used to urge said tip 61 over said shoulder edge 62 by means of pressing against the jog 11.

Figure 13:
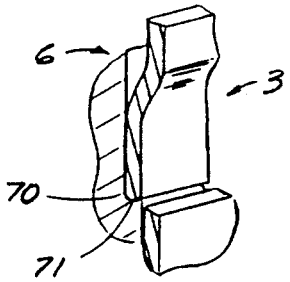

FIG. 13 is yet another embodiment of the invention where the tip 61 is a convex tip 70 and the shoulder edge 62 is a convex shoulder 72 whereby the engagement is in a detente condition.

What is claimed is:

1. A heat exchanger having a stiff shear over compression connection for securing a tank to a header plate and a separation tool to effect release of said tank from said header plate, said heat exchanger comprising:
   - the tank having a peripheral flange with a top shoulder and a bottom rim;
   - the header plate having an open ended peripheral groove with a bottom, a location shoulder and an upstanding wall extending about the agroove;
   - the upstanding wall having a plurality of apertures spaced longitudinally thereon, each aperture including a spring dog having an offset with an edge portion, said offset being directed downwardly and inwardly toward said groove;
   - a gasket disposed in said groove bottom and enclosed by said tank bottom rim;
   - whereby an interference fit between said tank top shoulder and said spring dog provides a clamped connection between the tank and header plate.

2. A heat exchanger according to claim 1, wherein said aperture is formed by three adjoining slits defining said spring dog, said spring dog being integral with said upstanding wall.

3. A heat exchanger according to claim 1, wherein said spring dog includes a retaining loop attachable to said upstanding wall.

4. A heat exchanger according to claim 1, wherein said tank is removable from said header plate by said separation tool, said tool having a tooth which is insertable in a gap between said upstanding wall and said tank at a location of said spring dog to eliminate said clamped connection.

5. A heat exchanger according to claim 4, wherein said tank top shoulder provides a stop for said tool tooth.

6. A heat exchanger according to claim 1, wherein said clamped connection is preloaded by a convex portion in said groove bottom.

7. A heat exchanger according to claim 1, wherein said clamped connection is preloaded by compression of said gasket by said tank bottom rim.

8. A heat exchanger according to claim 1, wherein said clamped connection is preloaded by said tool biasing said spring dog upon said tank top shoulder.

9. A heat exchanger according to claim 1, wherein said spring dog edge portion is convex and said tank top shoulder is concave.

10. A heat exchanger according to claim 1, including a core having a plurality of tubes and fins.

* * * * *